US006581805B2

(12) United States Patent
Conboy et al.

(10) Patent No.: US 6,581,805 B2
(45) Date of Patent: Jun. 24, 2003

(54) VISCOUS FLUID COMPOUND APPLICATOR

(75) Inventors: John S. Conboy, 2235 Devonsbrook Dr., Chesterfield, MO (US) 63005; Matt Jungklaus, Duluth, GA (US)

(73) Assignee: John S. Conboy, Chesterfield, MO (US)

( * ) Notice: Subject to any disclaimer, the term of this patent is extended or adjusted under 35 U.S.C. 154(b) by 31 days.

(21) Appl. No.: 09/981,450

(22) Filed: Oct. 17, 2001

(65) Prior Publication Data

US 2003/0072830 A1 Apr. 17, 2003

(51) Int. Cl.[7] ..... B67D 5/42

(52) U.S. Cl. ..... 222/340; 222/387; 222/388; 222/386

(58) Field of Search ..... 222/159, 389, 222/518, 509, 387, 388, 340, 386

(56) References Cited

U.S. PATENT DOCUMENTS 3,186,597 A * 6/1965 Henderson ..... 222/387
4,919,604 A 4/1990 Wilson
4,946,077 A 8/1990 Olsen
4,996,799 A 3/1991 Pound et al.
5,033,197 A 7/1991 Irvello
5,343,982 A 9/1994 Min
5,535,926 A 7/1996 Blitz et al.
5,695,788 A 12/1997 Woods
5,882,691 A * 3/1999 Conboy ..... 222/389

OTHER PUBLICATIONS

H.A. Guden Co., Brochure "The GGSX Gas Spring" No date.
AVM Inc., Product Sheet No. 040596 No date.
AVM Inc., Product Sheet No. 030895 No date.
AVM Inc., Product Sheet No. 020895 No date.

* cited by examiner

*Primary Examiner*—Philippe Derakshani
(74) *Attorney, Agent, or Firm*—Polster, Lieder, Woodruff & Lucchesi, L.C.

(57) ABSTRACT

A viscous applicator having a chamber for holding viscous fluid such as dry wall compound. A one-way filling valve and a discharge nozzle are located on the chamber. The nozzle is opened and closed using a pull rod connected to a seal on one end. The second end is controlled by a rotatable handle on the applicator main housing. A gas spring is located in the housing and retracts during loading of dry wall compound into the chamber and discharges compound when the discharge nozzle is opened by the pull rod. The handle is spring loaded to close the nozzle when released. A hollow push rod connects the gas spring to a dispensing head in the chamber and the pull rod is movable through the push rod and the dispensing head. A series of cam slots and followers controls motions of the handle and the pull rod.

13 Claims, 5 Drawing Sheets

VISCOUS FLUID COMPOUND APPLICATOR

CROSS-REFERENCE TO RELATED APPLICATIONS

Not applicable

STATEMENT REGARDING FEDERALLY SPONSORED RESEARCH OR DEVELOPMENT

Not Applicable.

BACKGROUND OF THE INVENTION

This invention relates to the application of viscous fluid compounds and to dry wall taping, and, in particular, to a machine for applying viscous fluid compounds such as dry wall compound, grout, caulk, sealants, etc. to joints and corners where dry wall tape and tape on comer bead is applied. The applicator of this invention is also usable in applying grout and other sealants.

Applying dry wall mix to joints is a very labor intensive job if done manually. If a dry wall taper uses present machines, the job is very demanding physically and in time causes injury to the back and shoulders of the taper because of the weight of the device and the physical force necessary to eject the taping compound from the device and apply it to the joint.

Accordingly, a principal object of this invention is to provide a machine in which a manually operated pump injects dry wall compound into the applicator from a supply receptacle and a gas operated spring assembly is used to eject the dry wall compound through a nozzle on the applicator in a controlled manner without requiring intense physical force from the operator of the device.

I described such a device in my prior U.S. Pat. No. 5,882,691 entitled Automatic Dry Wall Compound Applicator which issued Mar. 16, 1999.

This invention is an improvement on U.S. Pat. No. 5,882,691 in its method of releasing dry wall compound from the applicator.

Another object is to provide an applicator which easily comes apart to facilitate cleaning the dry wall compound out of the applicator parts.

Another object is to provide a method for filling the applicator without having to remove the finishing tool from the applicator.

These and other objects and advantages will become apparent hereinafter.

BRIEF SUMMARY OF THE INVENTION

The invention is embodied in a dry wall compound applicator comprising a main dry wall compound retaining cylinder having a dispensing and filling head on one end and a handle containing a control mechanism on the other end. Inside the handle is a nitrogen filled gas spring operatively connected to a hollow control tube which in turn is connected to a dispensing piston inside the dry wall containing cylinder. Inside the control tube is a pull rod which operates a closure for a dispensing nozzle on the cylinder. The pull rod is operatively connected to a control tube mounted on the handle and movable with respect to the handle to withdraw the closure and allow dry wall compound to be dispensed from the cylinder. The pull rod is spring biased to closed position. A one way fill valve is on the cylinder to permit filling the cylinder with dry wall compound and compression of the gas spring.

BRIEF DESCRIPTION OF THE SEVERAL VIEWS OF THE DRAWINGS

In the drawings, wherein like numbers refer to like parts wherever they occur.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what presently is believed to be the best mode of carrying out the invention.

Figure 1:
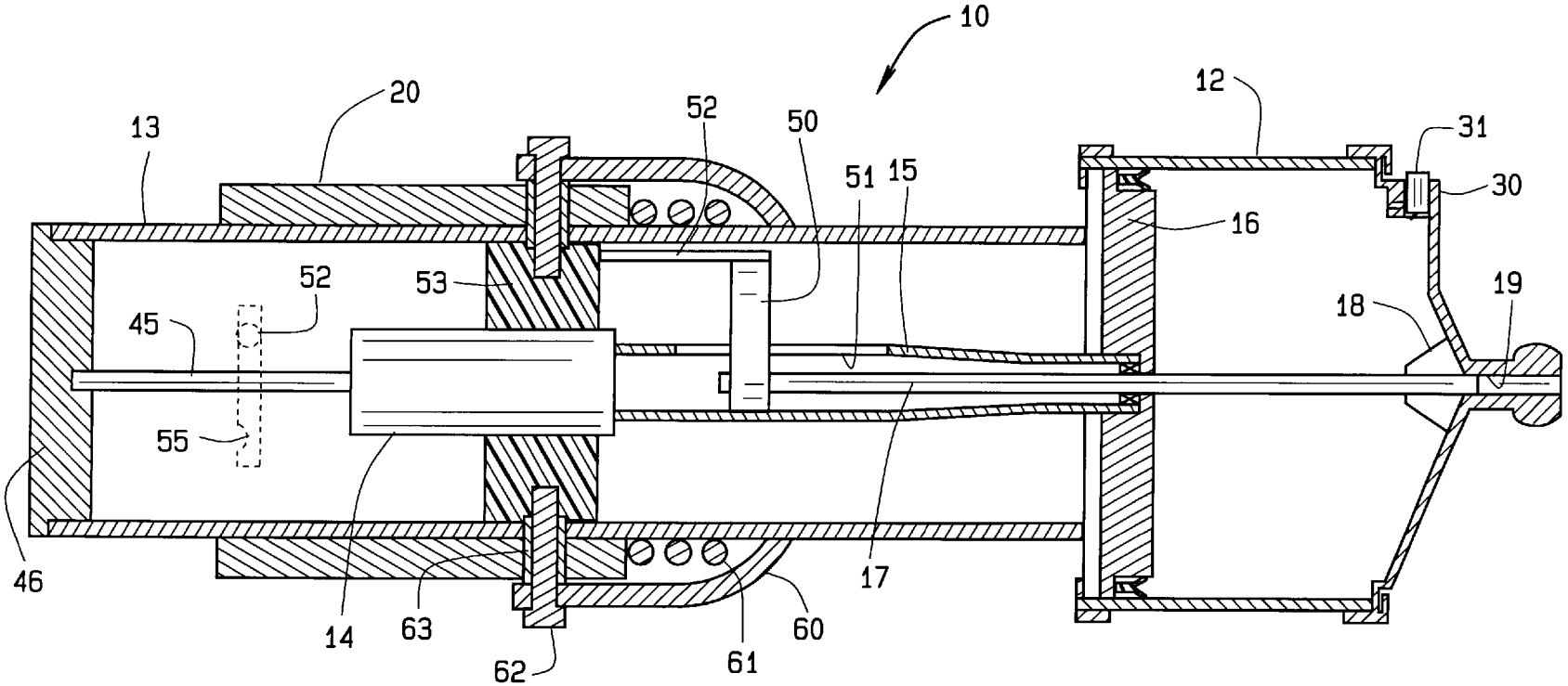
FIG. 1 is a sectional view of the dry wall compound applicator of this invention.

FIG. 1 shows the dry wall dispenser 10 in assembled relationship. The device 10 comprises a compound filling and dispensing nozzle assembly 11, a clear plastic compound retaining cylinder 12, a main tubular housing 13, an air spring 14 having a hollow push rod 15 connected between it and a compound dispensing head 16, a pull rod 17 slidably mounted in the push rod 15 having a needle plug 18 on its leading end for sealing the dispensing nozzle opening 19, and a spring biased control handle 20 rotatably mounted on the main housing 13 and operatively connected to the rear end of the pull rod 17 whereby rotation of the handle 20 opens and closes the dispensing nozzle opening 19.

Much of the assembly and construction of the dispenser 10 is similar to that shown in U.S. Pat. No. 5,882,691 which is incorporated herein by reference.

The nozzle assembly 11 includes a front nose 25 and a dispensing nozzle 26. It is shown in more detail in FIG. 2. Inside the front nose 25 is a plug seat 27 against which the plug 17 seats to seal the nozzle opening 19. The nozzle 26 has a ball 28 on the leading end. Universal finishing heads or dry wall heads (not shown) are adapted to be attached to the ball 28. These have an internal spherical socket and are snapped onto the ball 28 to define a ball joint assembly which allows universal pivoting of the head.

A loading boss 30 is located on the nose 25 and is provided with a conventional spring loaded fill valve assembly 31 which is opened to admit dry wall compound into the cylinder 12 and automatically closes when loading is stopped.

Inside the cylinder 12 is the dispensing head 16 which includes a peripheral wiper seal 33 to wipe the interior of the cylinder 12 and push the compound out of the cylinder during operation. The seal 33 prevents the dry wall compound from getting behind the head during either filling or dispensing.

The cylinder 12 preferably is made of a transparent plastic, such as polycarbonate, so that the operator can visually determine how much dry wall compound is in the cylinder 12.

Figure 2:
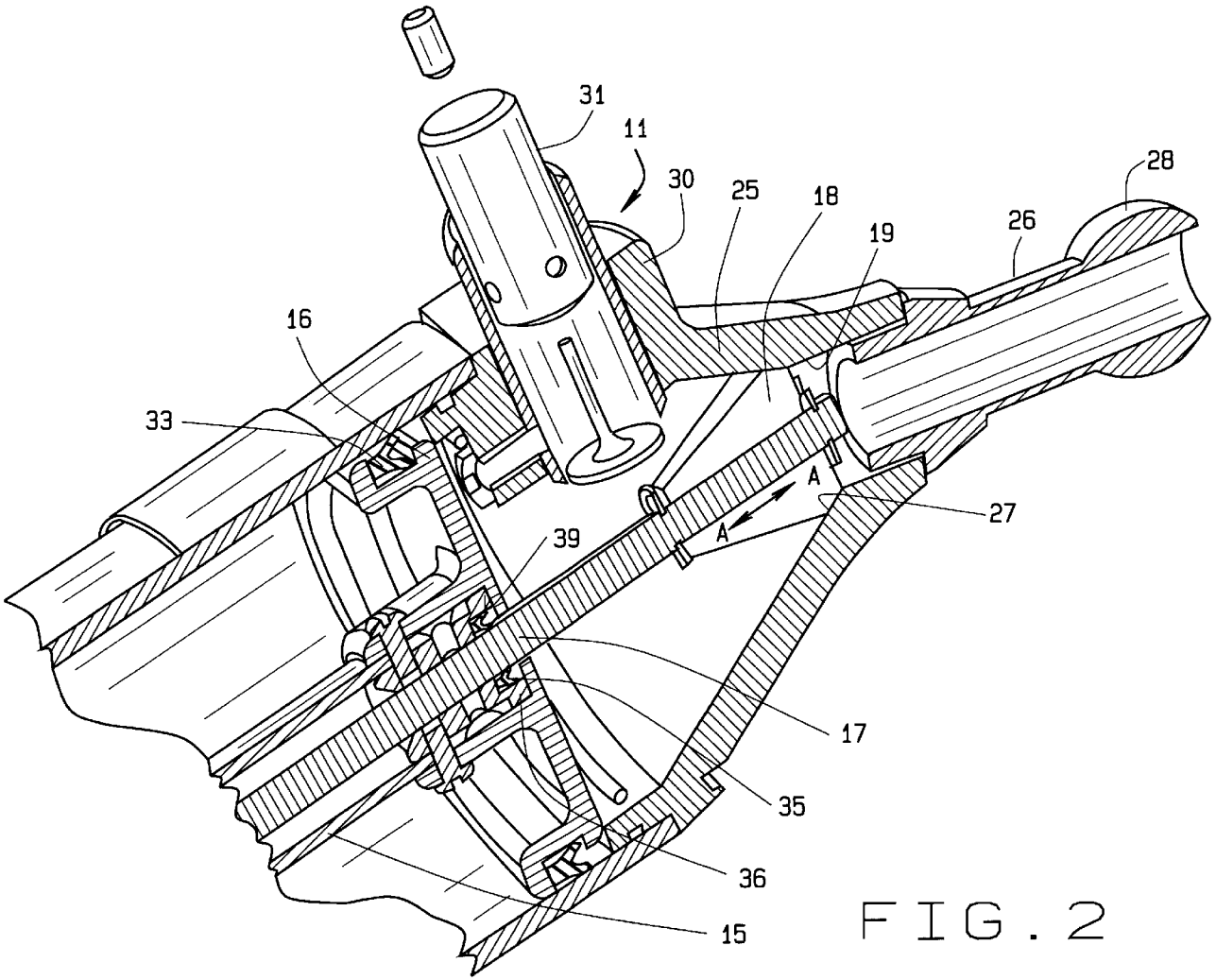
FIG. 2 is a fragmentary perspective view partly in section of the dispensing nozzle.

The pull rod 17 moves axially through the head 16 as shown by the arrows A-A in FIG. 2 to seal and unseal the nozzle opening 19 by moving the plug 18. Positioned behind the head 16 in a socket 34 is wiping seal 35. The seal 35 is positioned in a seal retainer 36. The pull rod 17 moves through the seal 35 when the head 16 moves with respect to the pull rod 17. The seal 35 prevents dry wall compound from passing past the head 16.

Figure 3:
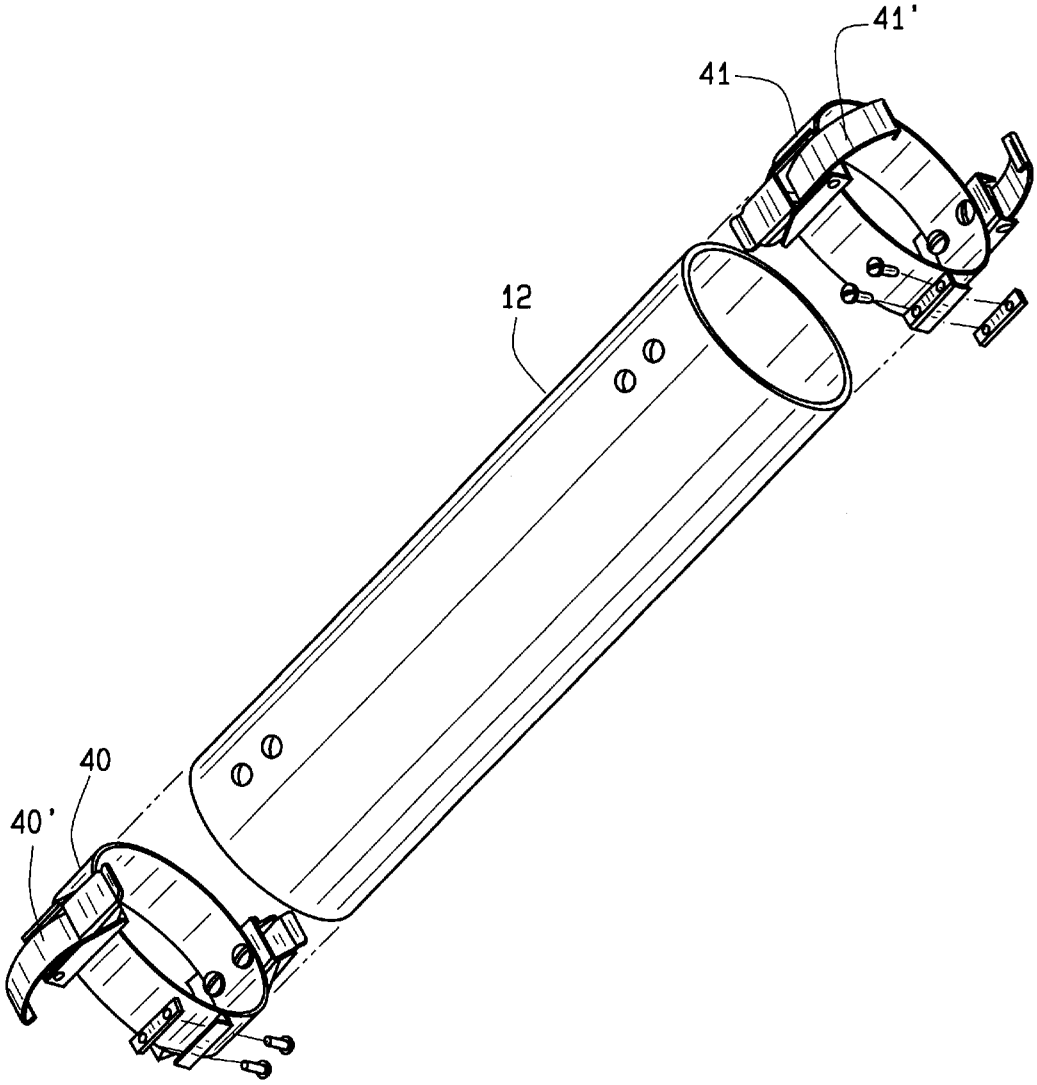
FIG. 3 is an exploded view of the compound storage chamber of this invention.
Figure 4:
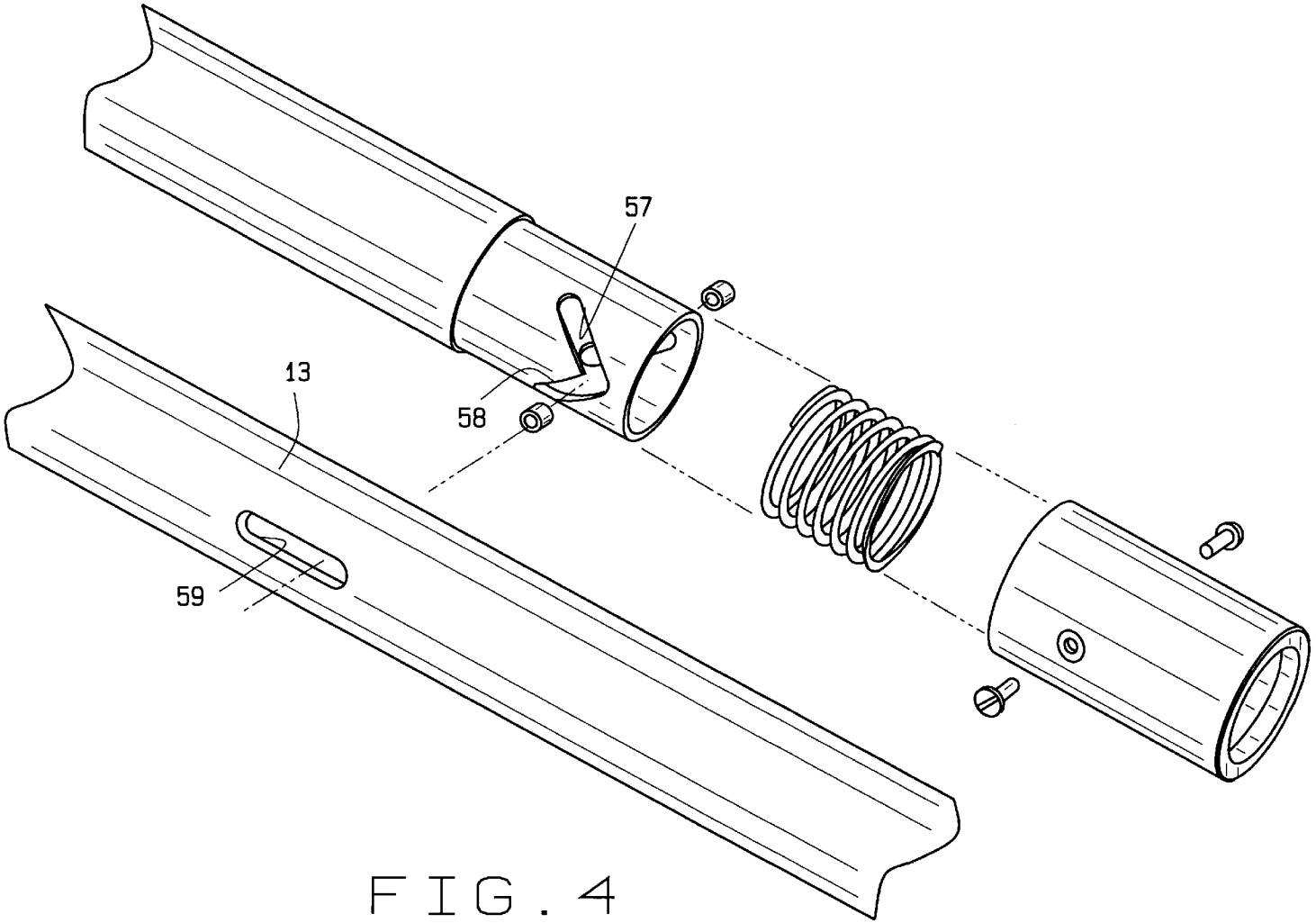
FIG. 4 is a fragmentary view of the control mechanism.
Figure 5:
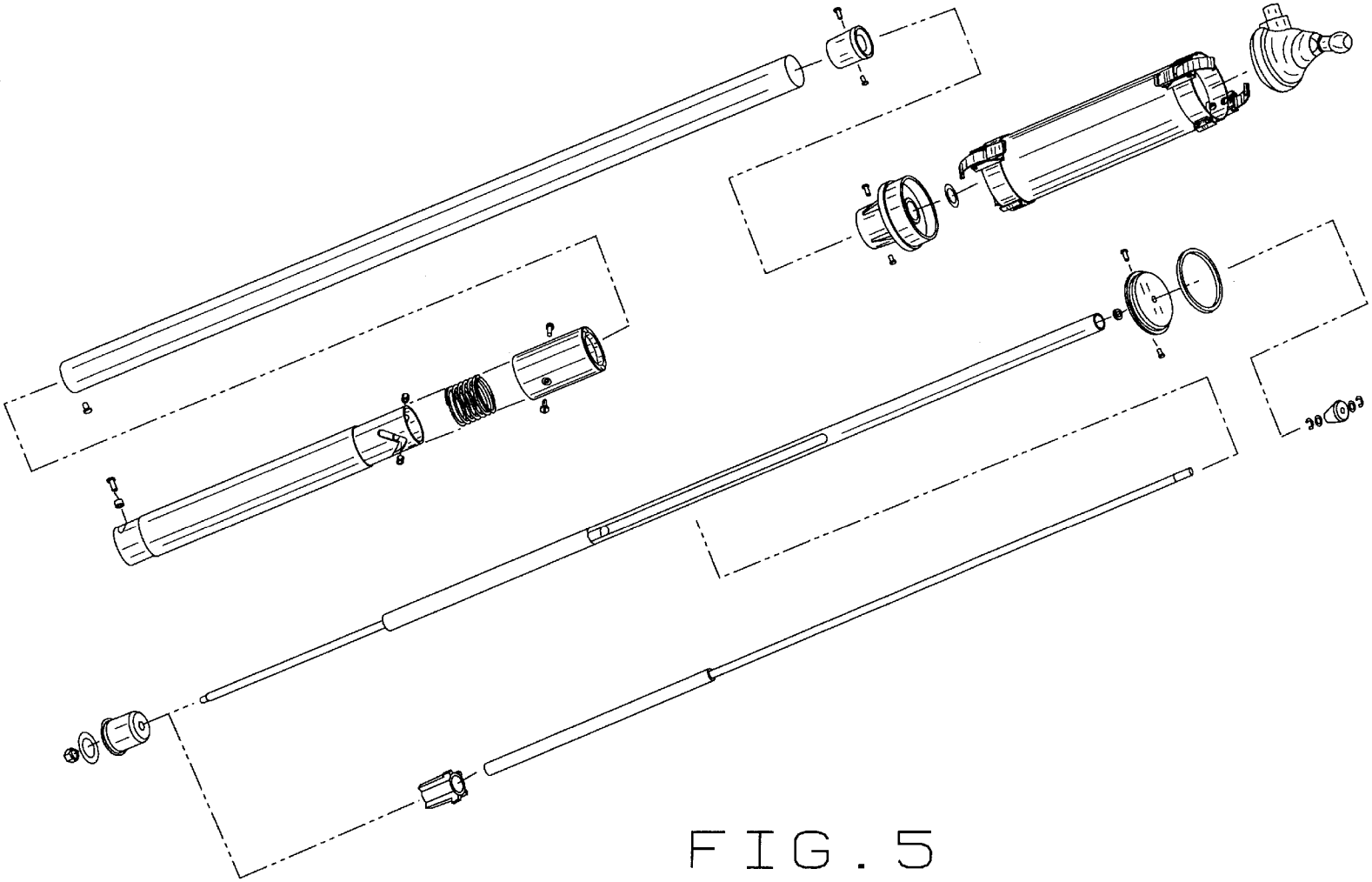
FIG. 5 is an exploded view of the assembly of the dry wall applicator.

The cylinder 12 is attached to the main housing 13 and to the nozzle assembly 11 by quick release snap rim retainer assemblies 41 which are secured to the cylinder 12 and have snap release retaining clips 40', 41' which clip onto suitable annular rims on the main housing 13 and the nozzle assembly 11 respectively. The retainer assemblies 40', 41' hold the parts in assembled condition and permit quick and rapid removal of the nozzle 11 from the cylinder 12 for cleaning. One can merely use a hose or pail of water to clean the tool after use by disassembling the nozzle 11 and cylinder 12. Another method of fastening the nozzle 11 to the cylinder 12 is by a threaded connection. Likewise, the cylinder 12 can be rapidly removed from the main housing 13 for cleaning. A threaded connection between the housing 13 and the cylinder 12 also is feasible. This is shown in more detail in FIG. 3.

Positioned within the main housing 13 is the gas spring 14. The gas spring assembly 14 is a standard item of commerce and is described in some detail in U.S. Pat. No. 5,882,691. As seen in FIG. 1 the gas seal 14 has an extended shaft 45 which is anchored in an end cap 46 which closes the rear end of the main housing 13. The push rod 15 is secured to the forward end of the gas spring 14. As the cylinder fills with dry wall compound, the push rod 15 moves rearwardly and, in turn, moves the air spring 14 toward the end cap 46, thus moving the shaft 45 into the air spring 14. This compresses the Nitrogen gas in the air spring 14 and effectively loads the air spring 14 and pressurizes the compound in the cylinder 12.

The control mechanism for permitting discharge of dry wall compound through the nozzle spring 19 includes the pull rod 17 which is located inside the hollow push rod 14, a connector arm 50 which is fastened to the rear end of the pull rod 17 and extends out of the push rod 15 and rides in a longitudinal slot 51 in the push rod 15. A connector 52 is attached to the connector arm 50 and extends rearwardly toward the end cap 46. The connector 52 is engaged with a wiper slide 53 which fits over and slidably engages the gas spring 14. Thus, the air spring 14 is located in the main housing 13 by the engagement of the shaft 45 and the end cap 46, the wiper slide 53 and the connection of the push rod 15 to the dispensing head 16.

The control handle or tube 20 is positioned over the main housing 13 and is rotatable with respect to the housing 13. A circumferential slot 55 is positioned toward the rear of the control tube 20 and a pin 56 is secured to the main housing 13 and runs in the slot 55. This permits rotational movement of the control tube 20 with respect to the main housing 13, but not axial movement. At the forward end of the control handle 20 are a set of angled cam slots 57,58. The slots 57,58 intersect at their forward ends and diverge rearwardly. Axially aligned with the angled slots 57,58 are longitudinal straight slots 59 on each side of the main housing 13.

A control cap 60 is positioned on the main housing 13 ahead of the control tube 20. Positioned between the control cap 60 and the control tube 20 is a spring 61. Pins 62 connect the control cap 60, the main housing 20 and the wiper slide 53. The pins 62 pass through bushings or cam followers 63 which ride in the angled slots 57,58 and the straight slots 59.

Thus when the control handle 20 is rotated, the pins 62 and bushings 63 move in the slots 57,58 to move the wiper slide 53 rearwardly and the wiper slide 53, in turn, pulls the push rod 17 rearwardly opening up the dispensing nozzle 19. At the same time, the control tube cap 60 is pulled toward the control handle 20 compressing the spring 61. When the handle 20 is released, the spring 61 urges the control tube cap 60 forwardly to move the wiper slide 53, the connector 52, and the push rod 15 forwardly to reseat the plug 18 in the plug seat 27 and stop dispensing compound from the nozzle 19.

The combination of the angled slots 57,58 in the control handle 20 and the axial slots 59 in the main housing 13 translate the angular motion into linear motion to retract the plug 18 from the nozzle opening 19.

The retraction of the plug 18 from the nozzle opening 19 can be done in other ways other than the twisting motion, such as buttons, levers, etc.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

Parts List

| DRY WALL COMPOUND APPLICATOR | | | |
|---|---|---|---|
| 10. | dispenser | 38. | |
| 11. | nozzle assembly | 39. | |
| 12. | cylinder | 40. | retainer assemblies, 40', 41' |
| 13. | main housing | 41. | |
| 14. | gas spring | 42. | |
| 15. | push rod | 43. | |
| 16. | dispensing head | 44. | |
| 17. | pull rod | 45. | shaft |
| 18. | plug on 17 | 46. | end cap |
| 19. | nozzle opening | 47. | |
| 20. | control handle | 48. | |
| 21. | | 49. | |
| 22. | | 50. | connector arm |
| 23. | | 51. | slot in 15 |
| 24. | | 52. | connector |
| 25. | front nose | 53. | wiper slide |
| 26. | dispensing nozzle | 54. | |
| 27. | plug seat | 55. | slot |
| 28. | ball | 56. | pin |
| 29. | | 57. | angle slot |
| 30. | boss | 58. | angle slot |
| 31. | fill valve | 59. | straight slot in 20 |
| 32. | | 60. | control cap |
| 33. | seal | 61. | spring |
| 34. | socket | 62. | pin |
| 35. | seal | 63. | bushings |
| 36. | seal retainer | 64. | |
| 37. | | 65. | |

What is claimed is:

1. A viscous fluid applicator comprising:

a) a chamber for holding a supply of viscous fluid, b) an applicator head on a first end of said chamber, said applicator head having a discharge nozzle, c) a dispensing head movable through said chamber for discharging viscous fluid from said nozzle, d) a main housing extending from a second end of said chamber, said main housing including a gas spring operator operatively connected to said dispensing head for moving said dispensing head through said chamber, said gas spring having loading and discharge modes, e) a loading mechanism for admitting viscous fluid into said chamber when said gas spring is in loading mode, and f) a discharge control mechanism operatively associated with the main housing for closing off said discharge nozzle when said gas spring is in loading mode and for opening said discharge nozzle when said gas spring is in discharge mode.

2. The applicator of claim 1 including a pull rod connected at one end to said discharge control mechanism and a seal on a second end adapted to close off the discharge nozzle, said pull rod being movable through the main housing in response to movement of said discharge control mechanism.

3. The applicator of claim 2 wherein the pull rod is movable through the dispensing head independently of the dispensing head.

4. The applicator of claim 3 including a seal in the dispensing head through which the pull rod moves.

5. The applicator of claim 1 including a push rod connecting the gas spring to the dispensing head and movable with the dispensing head.

6. The applicator of claim 5 wherein the push rod is hollow and the pull rod is positioned in part within the push rod and extends through the dispensing head and is movable independently of the dispensing head.

7. The applicator of claim 6 including a control handle mounted on the main housing, said handle being connected to the pull rod whereby movement of the handle opens and closes the discharge nozzle.

8. The applicator of claim 7 wherein the main housing and the control handle are connected by a series of slots and followers whereby the control handle is rotatable with respect to the main housing and is connected to the pull rod such that rotary movement of the handle translates to longitudinal movement of the pull rod to open and close the discharge nozzle.

9. The applicator of claim 8 wherein the control handle is spring biased toward the closed condition of the pull rod seal.

10. The applicator of claim 5 including a wiper slide positioned around the gas spring and connected to the control handle and the pull rod whereby the gas spring and the wiper slide are relatively longitudinally moveable during the loading and discharge modes of the gas spring and the opening and closing of the discharge nozzle.

11. The applicator of claim 9 including a cap operatively connected to the control handle and being positioned on the main housing and longitudinally movable along the main housing in response to rotational movement of the control handle, and resilient means interposed between the cap and the handle whereby rotational movement of the handle moves the cap toward the handle to compress such spring.

12. The applicator of claim 1 wherein the loading mechanism includes a one-way valve positioned on the applicator head.

13. The applicator of claim 1 including quick release mechanisms connecting the applicator to the chamber and the chamber to the main housing.

* * * * *